US005916278A

United States Patent [19]

Garcia

[11] Patent Number: 5,916,278

[45] Date of Patent: Jun. 29, 1999

[54] COMBINATION WRITING IMPLEMENT AND TURNING TOOL

[76] Inventor: Frank Garcia, 223 Pease Rd., Manalapan, N.J. 07726

[21] Appl. No.: 09/003,166

[22] Filed: Jan. 6, 1998

[51] Int. Cl.[6] ..... B25B 15/00

[52] U.S. Cl. ..... 7/165; 401/195

[58] Field of Search ..... 7/165, 170, 167; 401/195

[56] References Cited

U.S. PATENT DOCUMENTS

| | | | |
|---|---|---|---|
| 138,528 | 5/1873 | Reed et al. | 7/165 |
| 2,190,910 | 2/1940 | Nichols | 401/195 |
| 4,761,090 | 8/1988 | Goh | 401/195 |
| 5,638,566 | 6/1997 | Wu | 7/165 |
| 5,711,043 | 1/1998 | Crawford et al. | 7/165 |

*Primary Examiner*—David A. Scherbel
*Assistant Examiner*—Lee Wilson
*Attorney, Agent, or Firm*—Richard L. Huff

[57] ABSTRACT

A device which contains a combination of a writing implement or turning tool on one end and a turning tool on the other. The device contains a hollow casing, a forward end tip containing a central passageway for extension and retraction of the writing implement or turning tool on one end of the casing and a rearward tip containing a central passageway for the extension and retraction of the turning tool rod at the other end of the casing. The turning tool may be a Phillips head screw driver, a flat head screwdriver, a torx, or an Allen wrench. The turning tool rod is reversible and contains, e.g., a flat head screwdriver on one end and a Phillips head screwdriver on the other end. The device contains a slideable extension/retraction mechanism which allows only the writing implement, only the tool rod, or neither of these to be exposed at any one time. The tool rod is prevented from turning relative to the casing. Thus, the end tip is securely fastened to the casing and the central passageway is of a non-circular shape. The tool rod is of the same shape as the central passageway. Alternatively, the device contains forward and rearward extension/retraction slots allowing independent control of the forward and rearward mechanisms. A pocket clip may be attached to the casing. The purpose of the device is to combine two commonly used implements in one convenient, easy-to-use unit, thus eliminating the need to carry two or more separate implements.

20 Claims, 14 Drawing Sheets

COMBINATION WRITING IMPLEMENT AND TURNING TOOL

BACKGROUND OF THE INVENTION

1. Field of the Invention

The present invention relates to a combined writing implement and turning tool, and more particularly, to a pen or pencil which is extendible and retractable on one end of the implement and a reversible rod which carries a Phillips head screwdriver, flat edge screwdriver, torx, Allen wrench, or other turning tool which is extendible and retractable on the other end of the implement. Alternatively, both ends may carry a turning tool, e.g. one flat head screw driver and one Allen wrench.

2. Description of the Related Art

The combination of writing implements and tools on the same holder is known in the art.

Nichols, in U.S. Pat. No. 2,190,910, describes an extendible/retractable writing implement which serves as a holder for a removable screwdriver. This implement has the disadvantage of requiring the removal of the screwdriver whenever its use is desired. This removal involves a plurality of steps. The separate screwdriver contains a short handle which is difficult to hold and turn and may become lost because of its small size.

Wu, in U.S. Pat. No. 5,638,566, describes a writing implement which is combined with a plurality of tools, including a Phillips head screwdriver and a flat head screwdriver. The writing implement and the tools are not extendible and retractable and remain exposed at all times. This presents the possibility of unsightly shirt pockets as the implement is intended to be carried in a shirt pocket. Also, the tool is constantly exposed and presents a danger, especially when the tool is a cutting blade. The screwdriver is attached to the casing by threads which turn when the screwdriver is used, tending to loosen the screwdriver. Any attempt to make the writing point and tools extendible and retractable would necessitate the destruction of the capability of the implement to carry a plurality of tools inside the implement.

The present invention is designed to provide the convenience of providing an extendible/retractable combination of a writing implement and a turning tool or two turning tools in a single implement while overcoming the disadvantages inherent in the implements of the prior art.

SUMMARY OF THE INVENTION

The present invention provides an implement which is a combination of a writing implement and a turning tool or a combination of two turning tools. A hollow casing contains a forward tip at one end through which a pen or pencil point or a tool rod may be extended or retracted. At the other end of the hollow casing is a flat surface having a non-circular opening through which a tool rod may be extended or retracted. The tool rod contains a turning tool on at least one end. This rod may be positioned such that either of the ends will be operational. The casing contains at least one longitudinal slot. Each slot provides for the use of means to enable the tip of the writing implement and/or the tool rod to be extended and retracted. Thus, with a single slot, only the forward work piece, only the rearward tool rod or neither of these will be exposed. When two slots are present, the forward work piece and the rearward tool rod may be independently moved.

DESCRIPTION OF THE PREFERRED EMBODIMENTS

Figure 1:
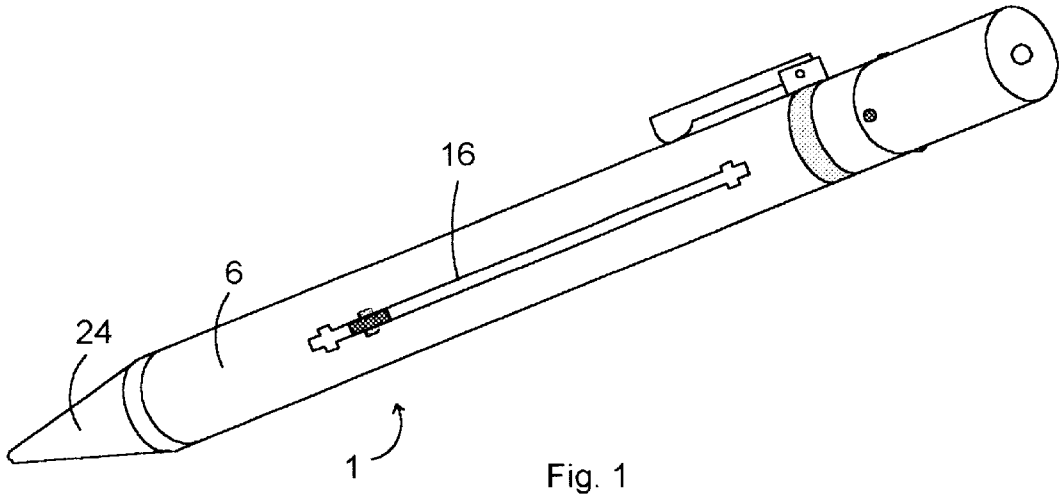
FIG. 1 is an elevational perspective view of a device according to the first preferred embodiment of this invention.
Figure 2:
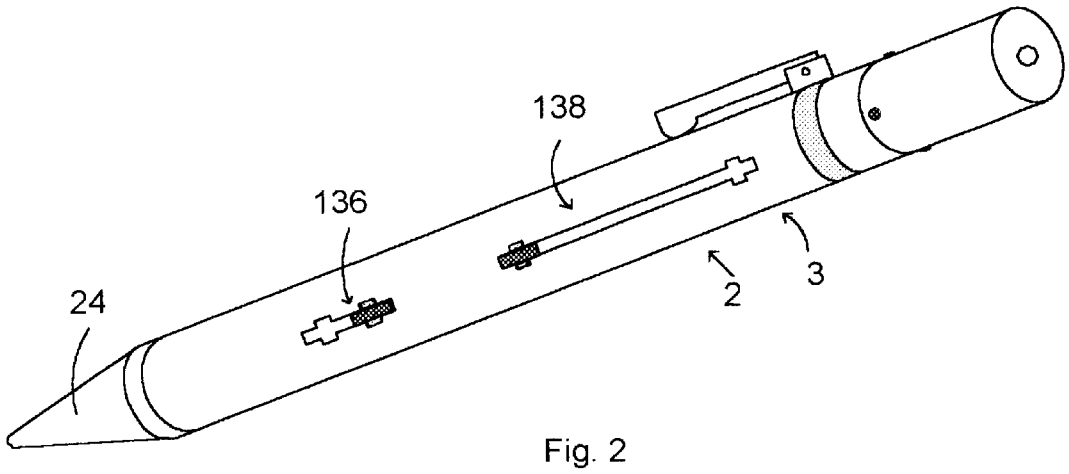
FIG. 2 is an elevational perspective view of a device according to the second and third preferred embodiments of the present invention.
Figure 3:
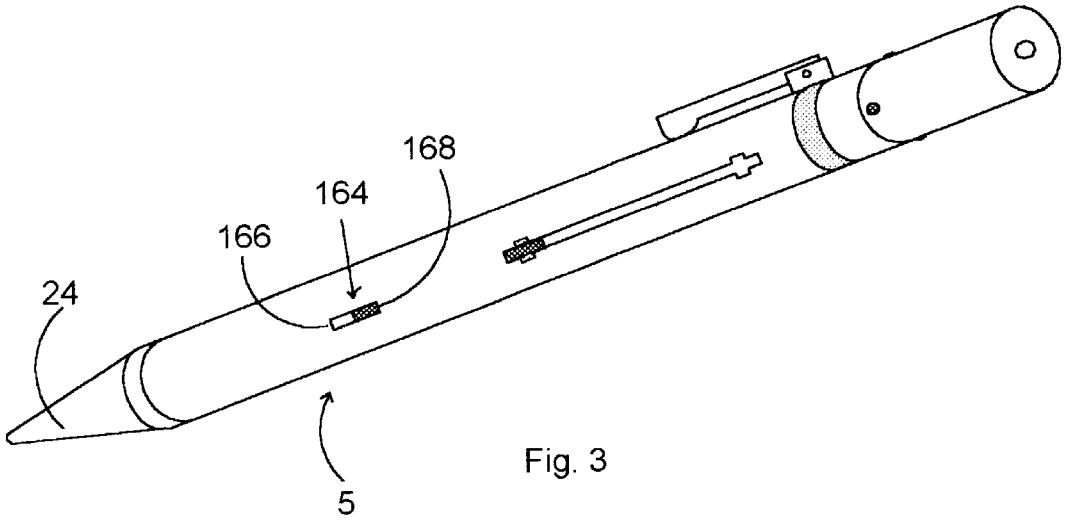
FIG. 3 is an elevational perspective view of a device according to the fourth preferred embodiment of the present invention.
Figure 4:
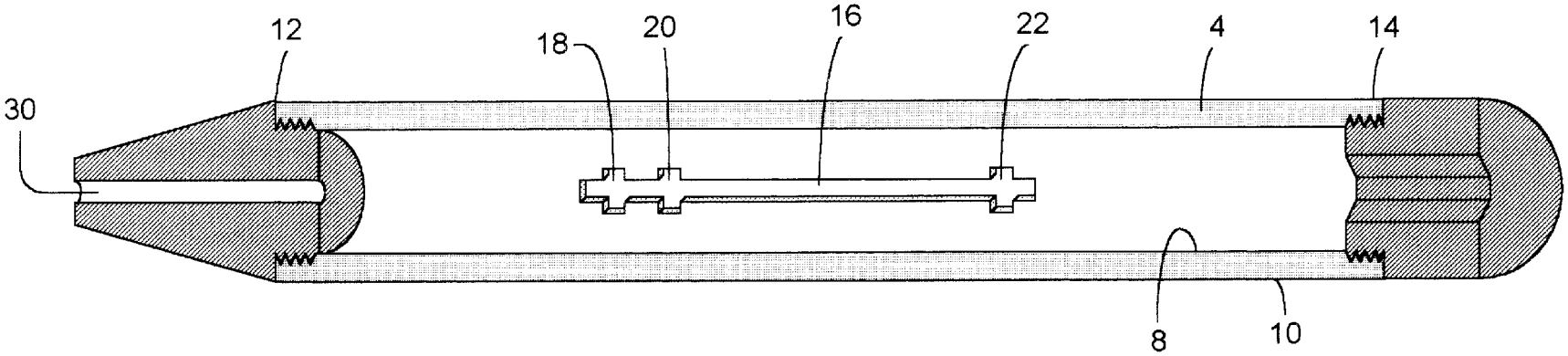
FIG. 4 is a top elevational view, partly in cut-away, of the device according to the first preferred embodiment of the present invention.
Figure 5:
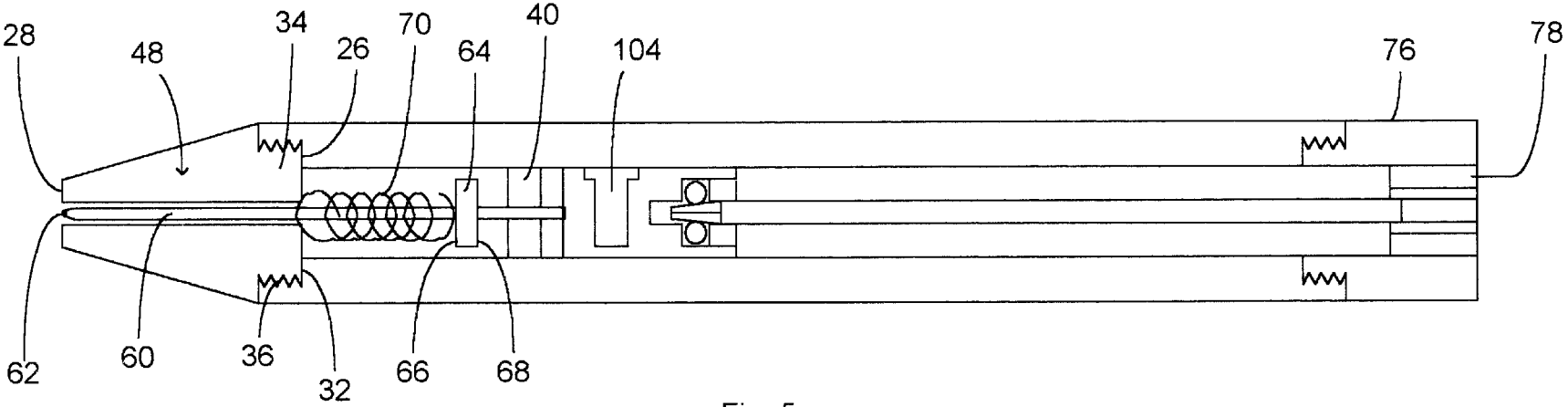
FIG. 5 is a longitudinal cross-sectional view of the device according to the first preferred embodiment of this invention.
Figure 6:
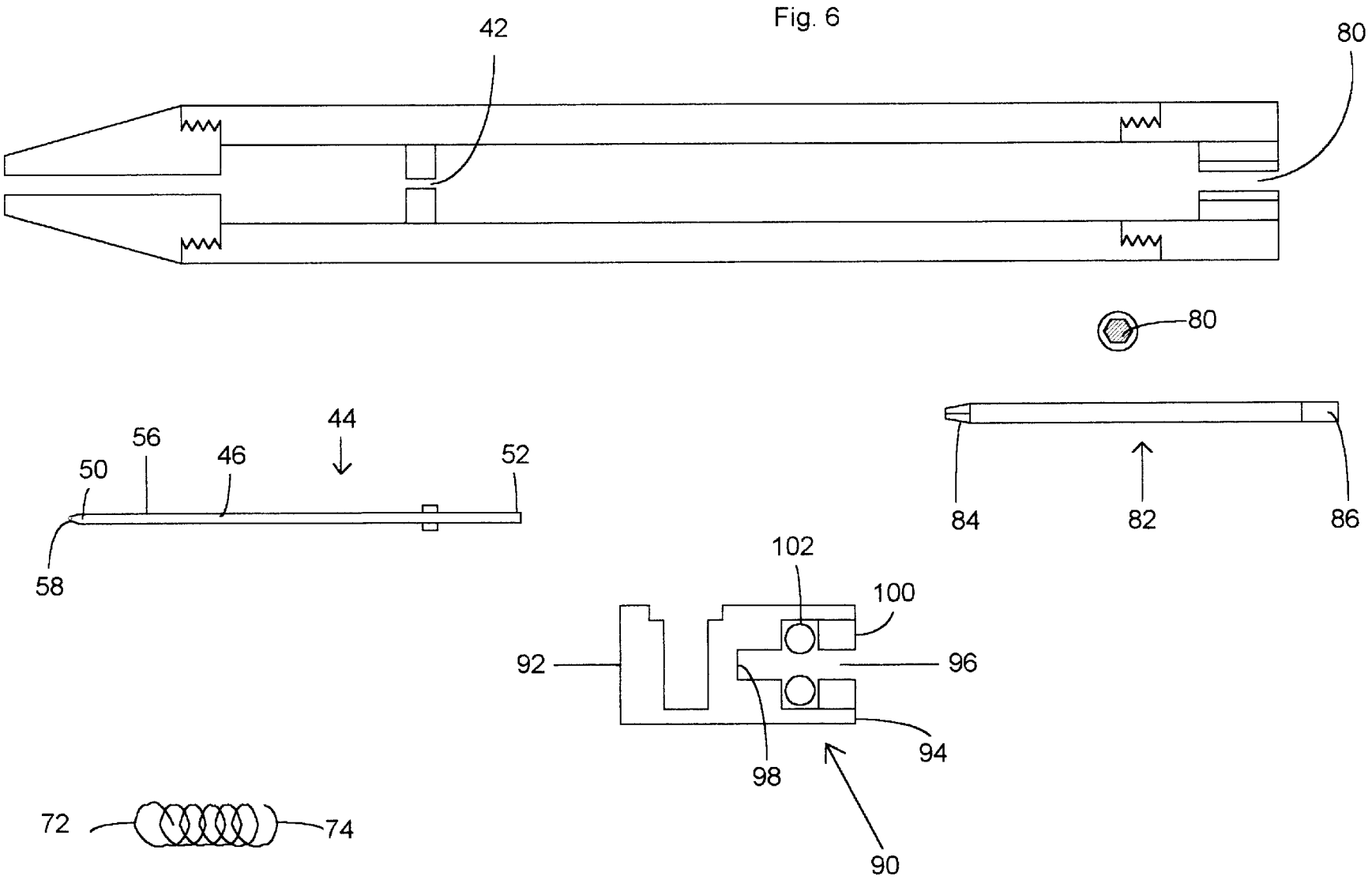
FIG. 6 is an exploded longitudinal view of the device according to the first preferred embodiment of the present invention.
Figure 7:
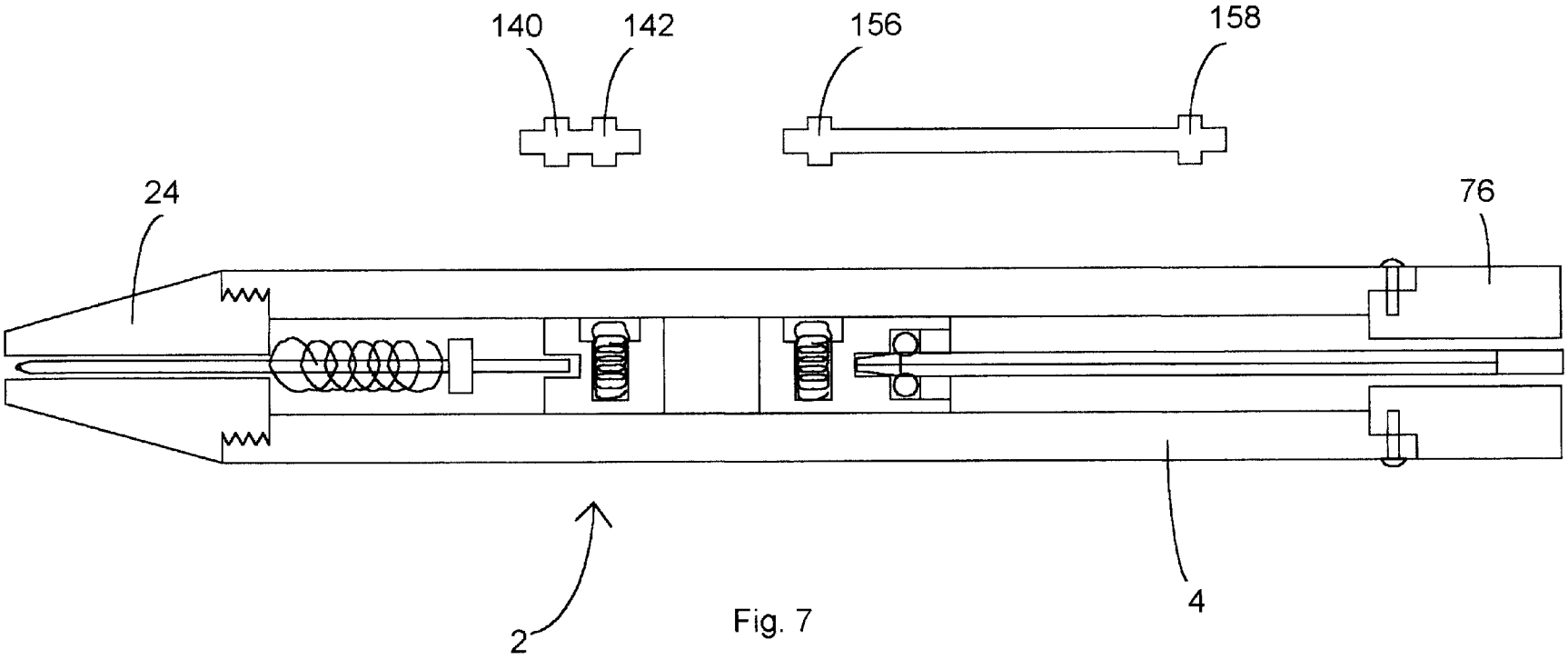
FIG. 7 is a longitudinal cross-sectional view, partially exploded, of a device according to the second preferred embodiment of the present invention.
Figure 8:
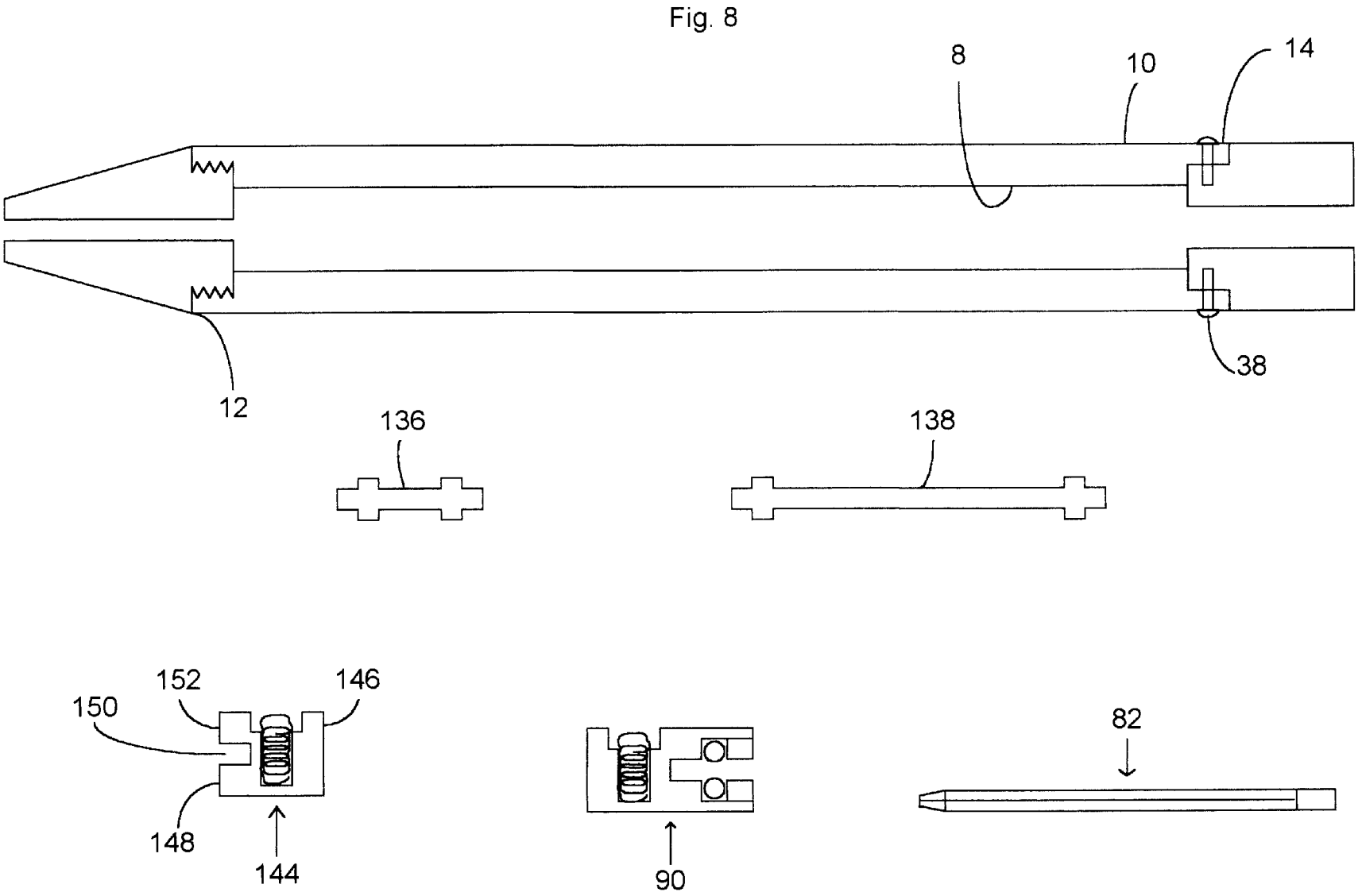
FIG. 8 is an exploded view of the device of the second preferred embodiment of the present invention.
Figure 9:
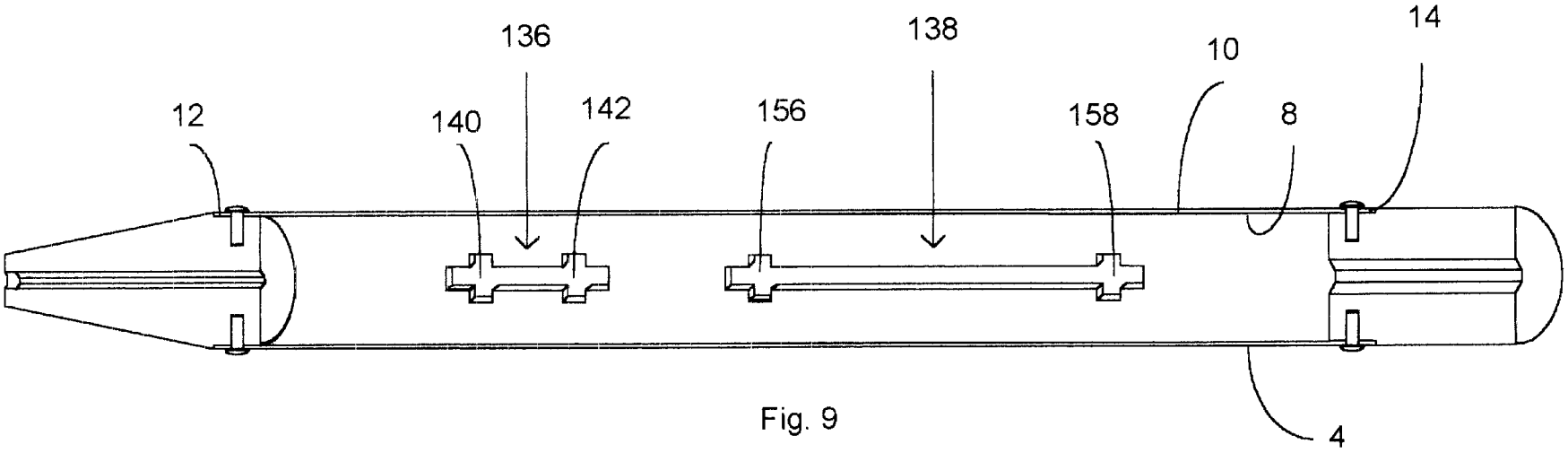
FIG. 9 is a top plan view, partly in cut-away, of a device of the third preferred embodiment of the present invention.
Figure 10:
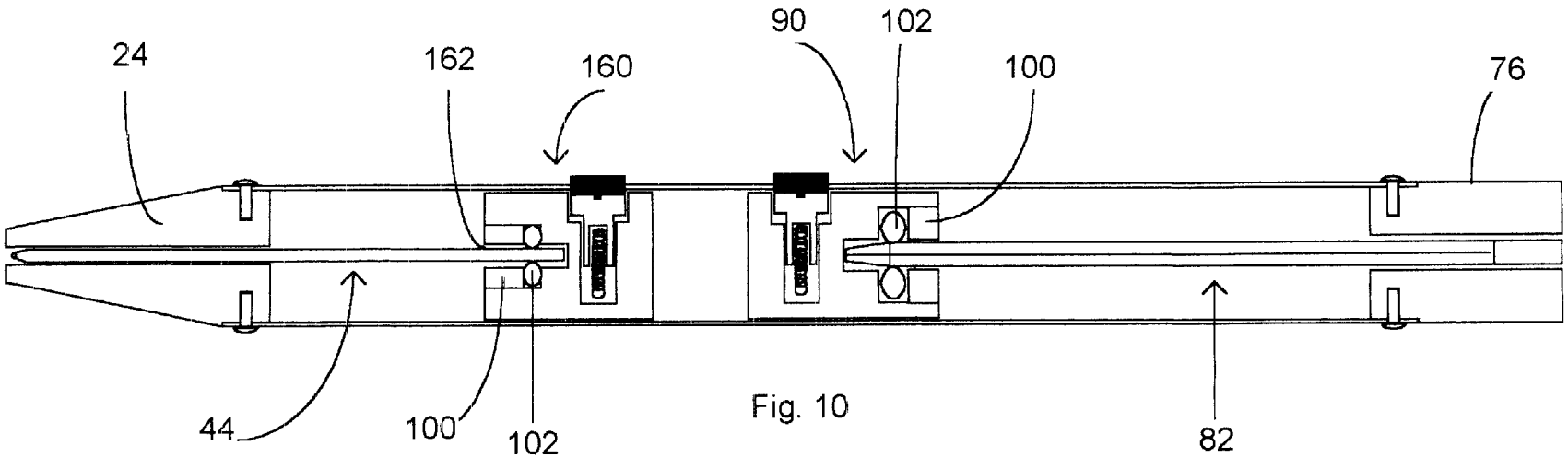
FIG. 10 is a longitudinal cross-sectional view of a device according to the third preferred embodiment of the present invention.
Figure 11:
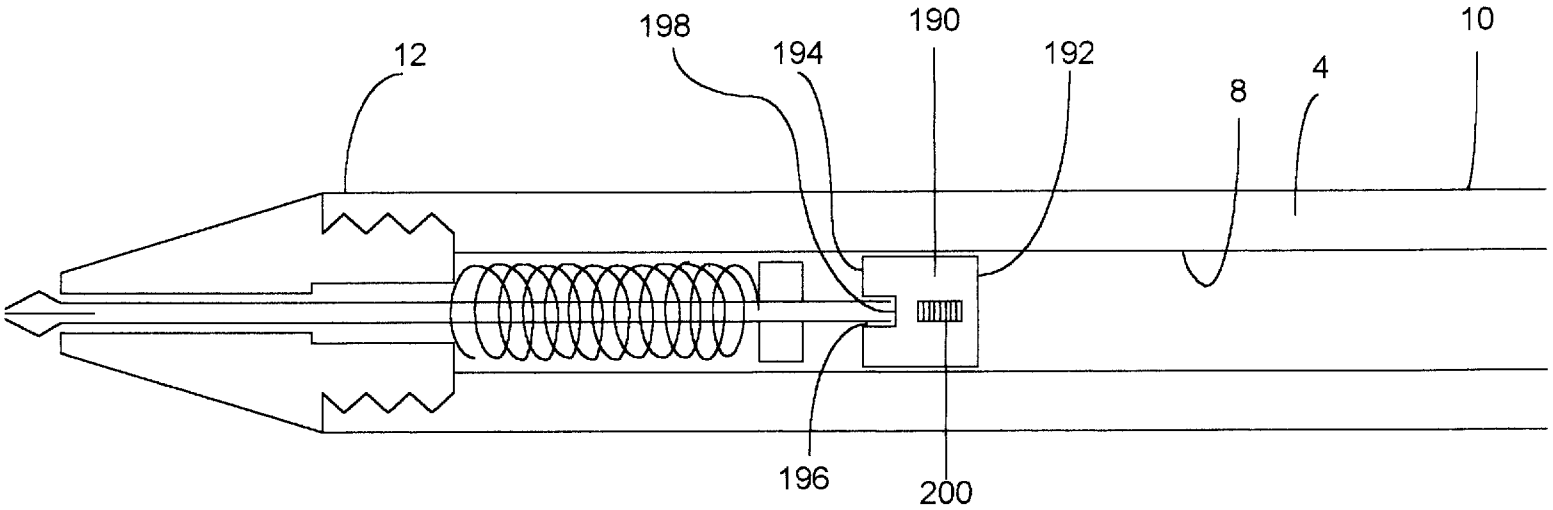
FIG. 11 is a longitudinal cross-sectional view showing the forward end of the device according to the fourth preferred embodiment of this invention..
Figure 12:
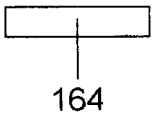
FIG. 12 is a top plan view of the forward extension/retraction slot of the fourth embodiment of this invention.
Figure 14:
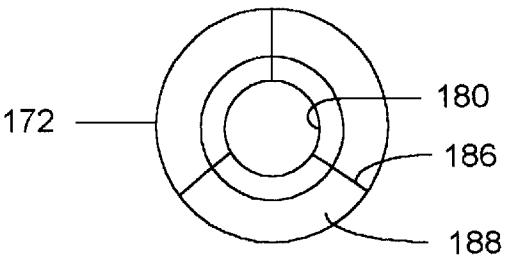
FIG. 14 is a front elevational view of the device according to the fourth preferred embodiment of the present invention.
Figure 13:
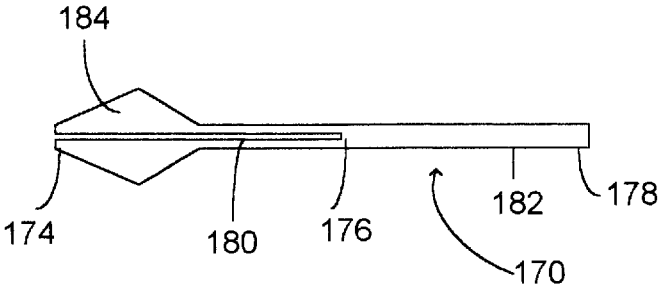
FIG. 13 is a longitudinal cross-sectional view of the chuck and gripping mechanism of the fourth embodiment of the present invention.
Figure 15:
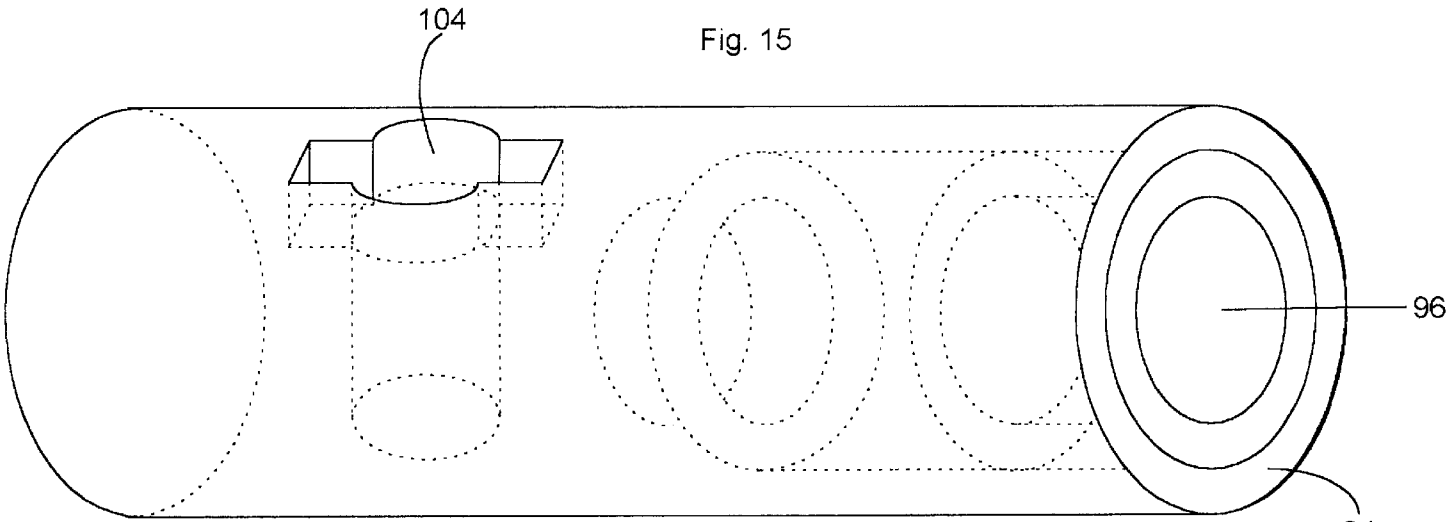
FIG. 15 is an elevational perspective view of a rearward extension/retraction pin as used in the four preferred embodiments of the present invention as well as the forward extension/retraction pin as used in the third preferred embodiment of this invention.
Figure 16:
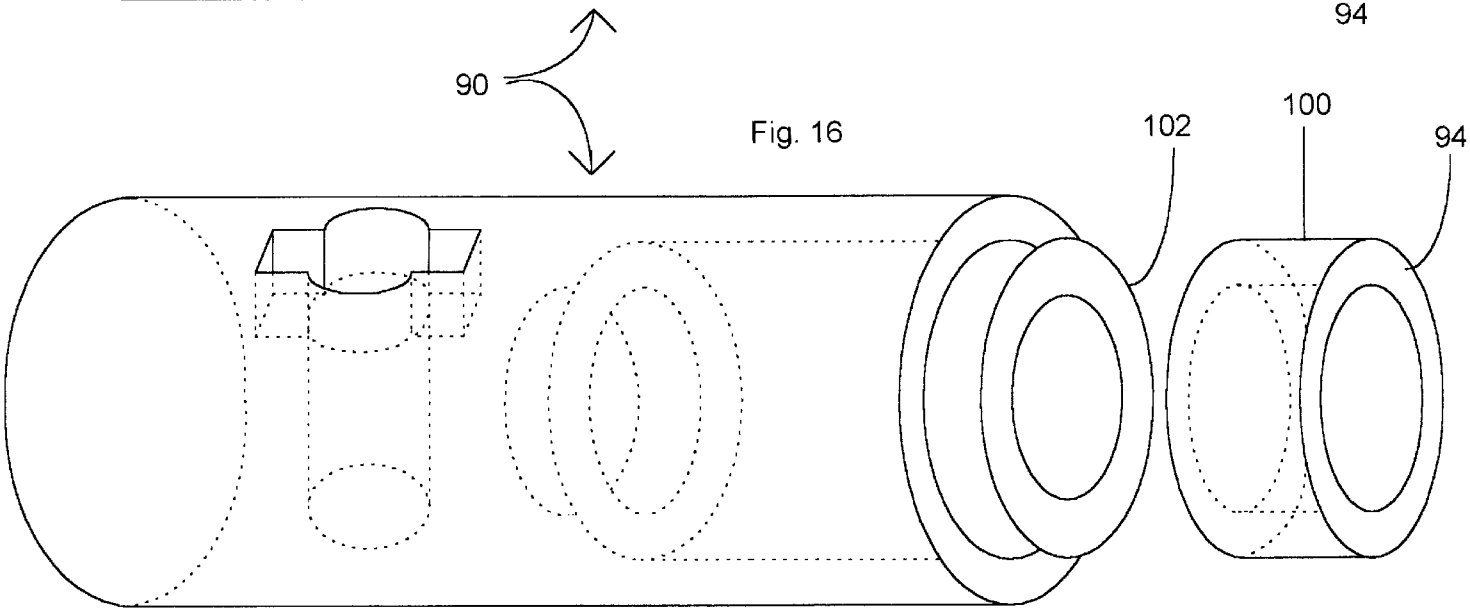
FIG. 16 is an elevational perspective view, partly exploded, of the extension/retraction pin illustrated in FIG. 15.
Figure 18:
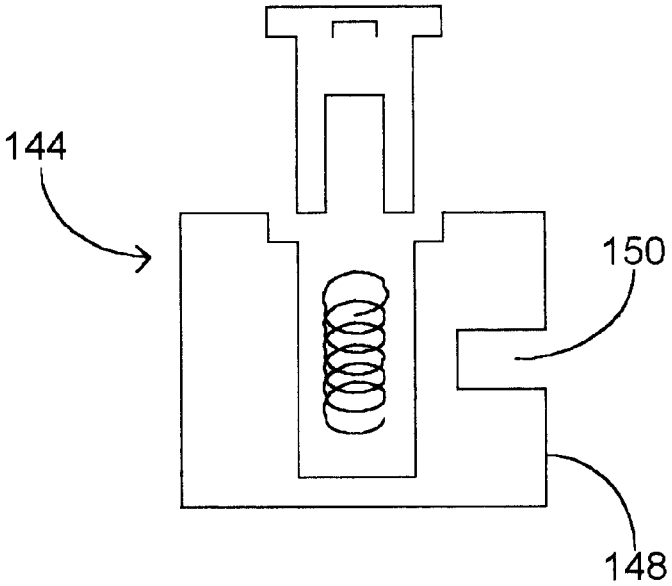
FIG. 18 is a longitudinal cross-sectional view of the forward extension/retraction pin as used in the second embodiment of the present invention.
Figure 17:
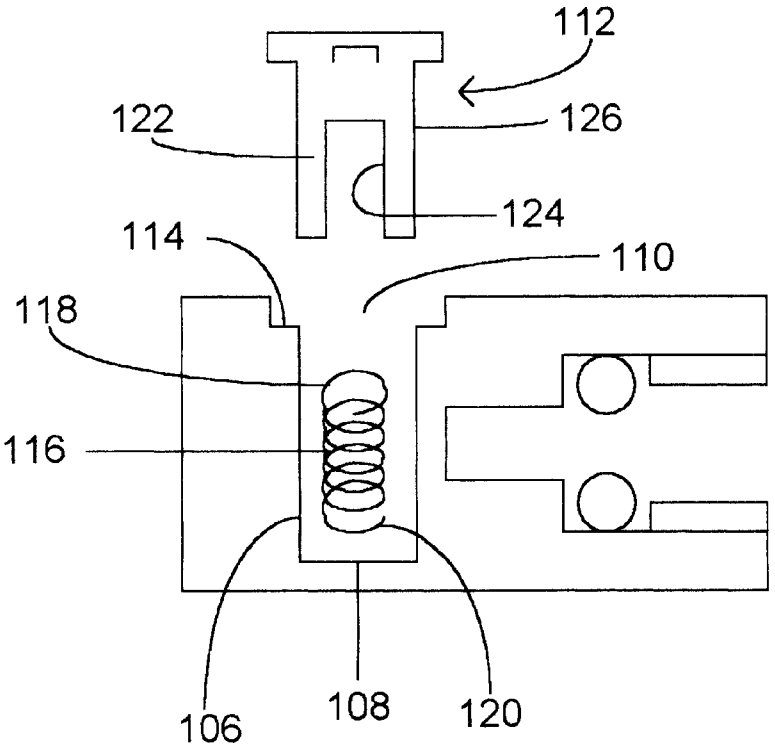
FIG. 17 is a cross-sectional longitudinal view of the rearward extension/retraction pin as used in the four preferred embodiments of the present invention as well as the forward extension/retraction pin as used in the third preferred embodiment of this invention.
Figure 21:
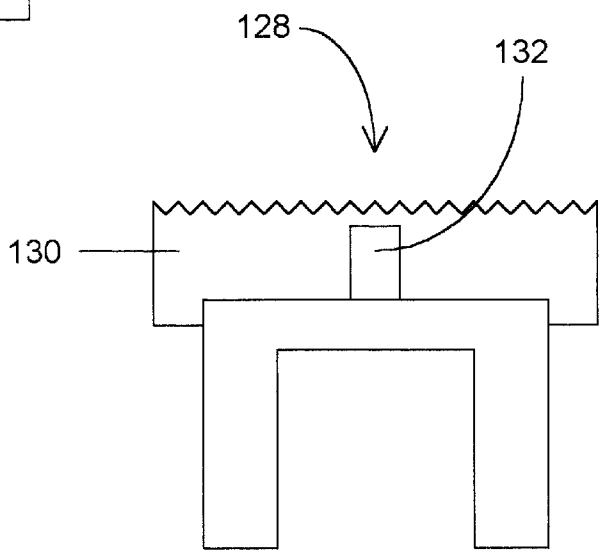
FIG. 21 is a side elevational view of a latch pin of the present invention.
Figure 20:
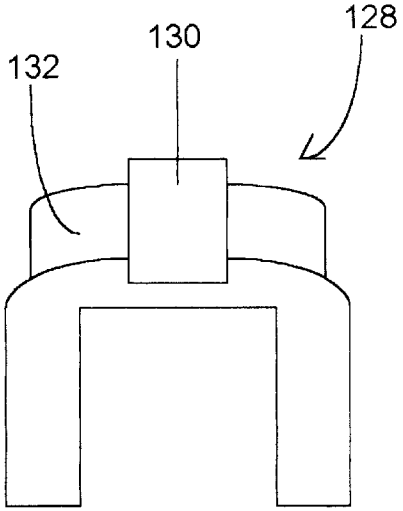
FIG. 20 is a front elevational view of a latch pin according to the present invention.
Figure 19:
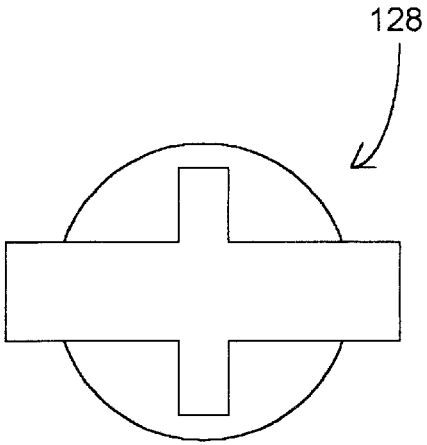
FIG. 19 is a top plan view of the latch pin of the present invention.
Figure 22:
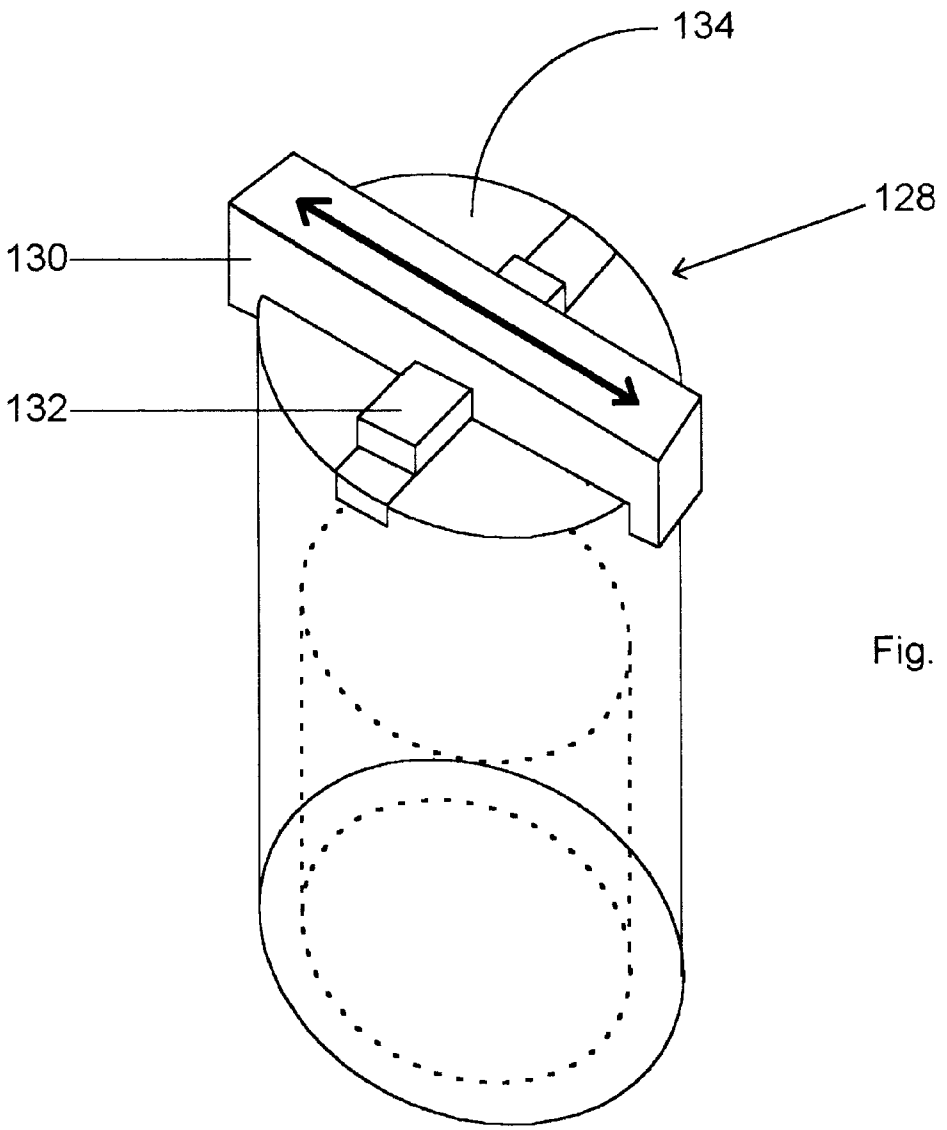
FIG. 22 is an elevational perspective view of a latch pin according to the present invention.
Figure 23:
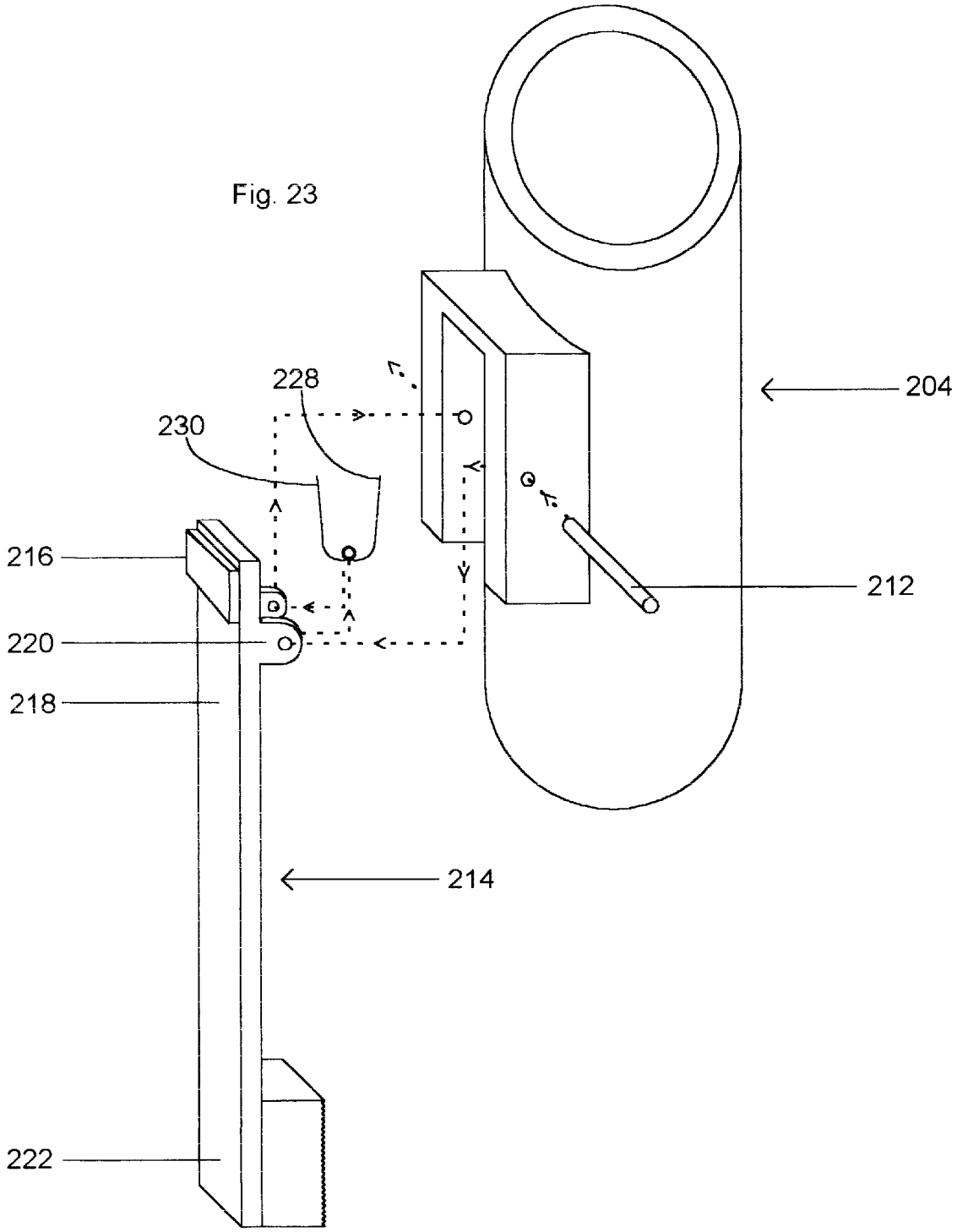
FIG. 23 is an exploded elevational perspective view of the pocket clip of the present invention showing a ring collar.
Figure 24:
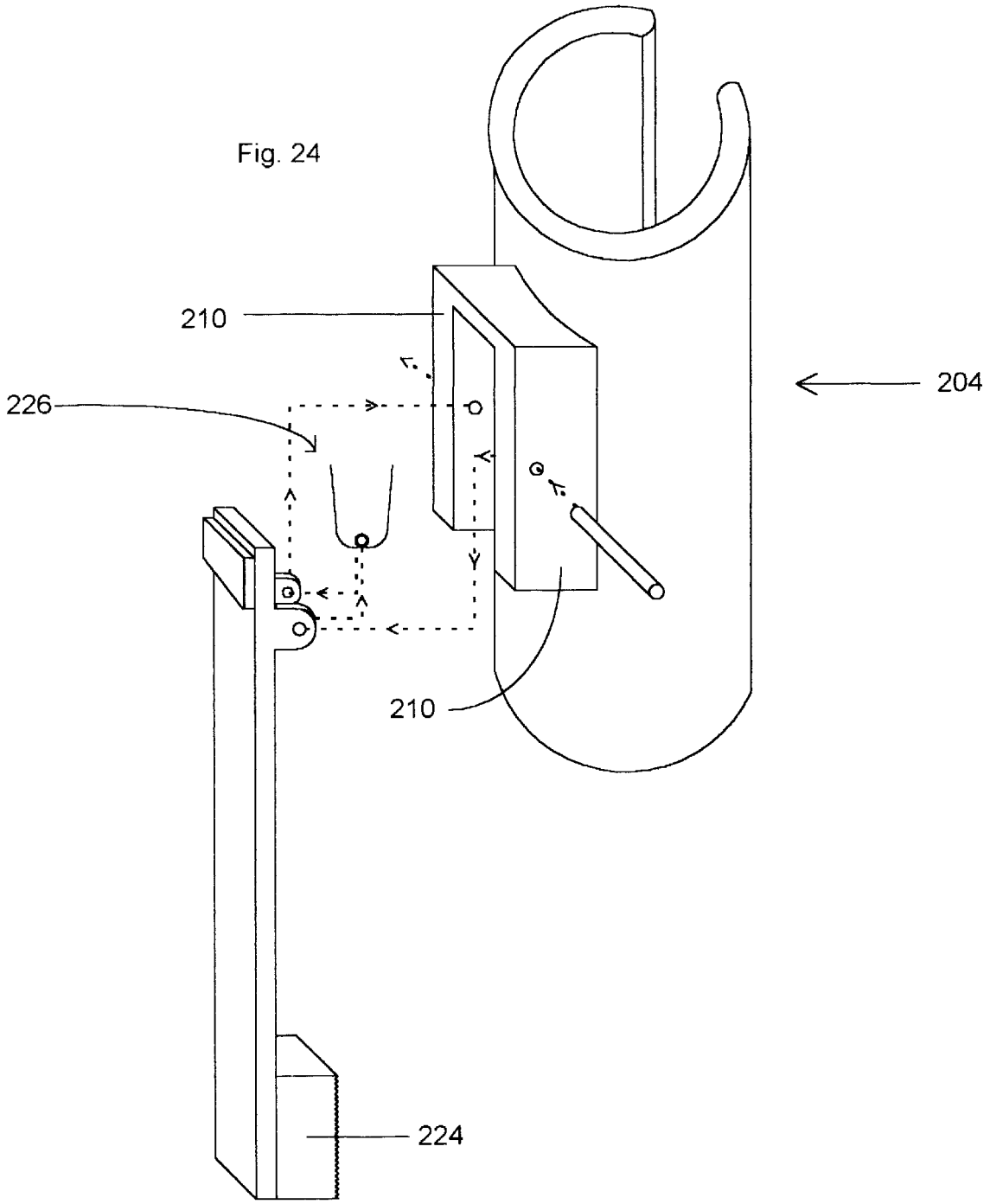
FIG. 24 is an exploded elevational perspective view of the pocket clip of the present invention showing a clip-on collar.
Figure 25:
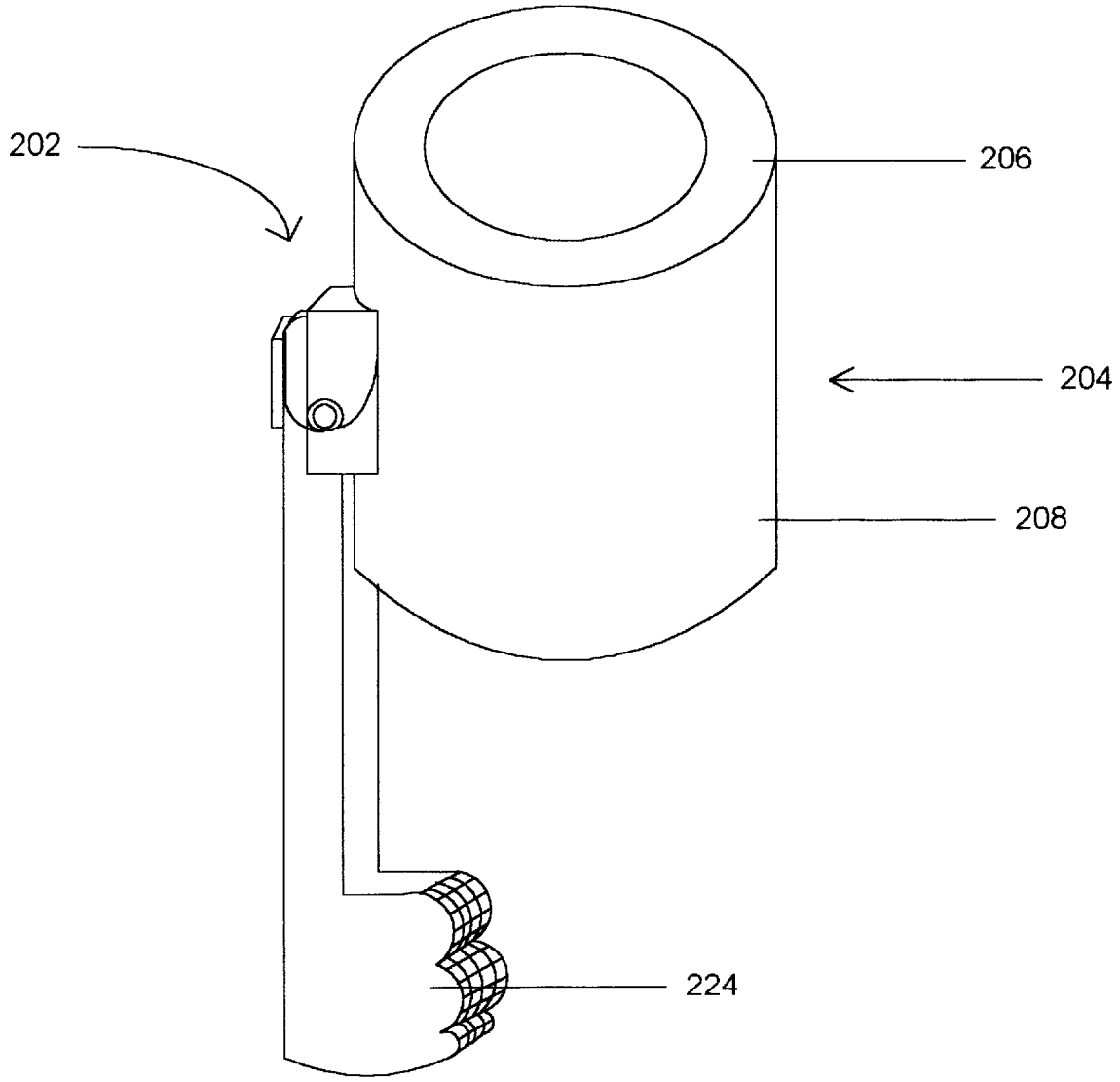
FIG. 25 is a pocket clip of the present invention showing the textured gripping head.

The present invention will now be described with reference to the above drawing. Like numerals refer to like features throughout the description.

In the first preferred embodiment, the device 1 comprises a casing 4 having a top aspect 6, an inner surface 8, an outer surface 10, a forward end 12, and a rearward end 14. The casing 4 may have any cross-sectional configuration, although circular and hexagonal are preferred. The casing 4 may have a smooth outer surface 10 or may be textured for a better feel and more secure grip. Texture may be imparted by tooling or the presence of a cover, such as a rubber sheath. The casing 4 has a longitudinal extension/retraction slot 16 extending through it along the top aspect 6, which slot 16 is approximately ⅓–½ the length of the casing 4. The slot 16 has forward 18, medial 20, and rearward 22 latch openings, which are enlarged openings in the slot 16. The latch openings 18 20 22 may be of any convenient shape, although rectangular and circular are preferred. The casing 4 is of such a size as to be comfortably held in the hand when being used as a writing implement or a turning tool. Thus, a length of between 12 and 16 cm and a diameter between 0.8 and 1.6 cm are preferred. The casing 4, as well as other components of the device 1, is made of any suitable material, such as metal or plastic, with stainless steel being preferred.

A front end tip 24 having a rearward base 26 and a forward apex 28 is removeably affixed to the forward end 12 of the casing 4. At the forward apex 28, there is a central axial passageway 30. The forward end tip 24 may be solid or hollow, preferably solid. In the event it is solid, the passageway 30 extends throughout the length of the forward end tip 24. The forward end tip 24 is removeably attached to the casing 4 in any convenient fashion. In a preferred embodiment, the thickness of the casing wall 4 at its forward end 12 is reduced to form a forward rim 32 and the central portion 34 of the forward end tip 24 is extended rearwardly allowing a nesting of the forward end tip 24 in the casing 4. The casing 4 and the forward end tip 24 may contain threads 36 and the forward end tip 24 may be screwed into the casing 4. Alternatively, 4–8 threaded holes may be present in the forward rim 32 of the casing 4 and the nested forward end tip 24 is held in place by bolts.

In a first embodiment, there is a barrier 40 fixedly attached within the casing 4 approximately one quarter of the distance from the forward end 12 to the rearward end 14 of the casing 4. The barrier 40 has a central axial passageway 42 of the same size and shape as that in the forward end tip 24. Fixation of the barrier 40 to the inner surface 8 of the casing 4 may be by welds, adhesives, rivets 38, bolts, or press fit.

A forward work piece 44, which may be an ink cartridge 46 or a tool rod 48, fits through the central axial passageway 30.

The forward work piece 44 has a forward end 50, a rearward end 52, and an outer surface 56.

When the forward work piece 44 is an ink cartridge 46, it has a writing point 58 at the forward end 50. In this alternative, the central axial passageways 30 42 in the forward end tip 24 and the barrier 40 are circular.

When the forward work piece 44 is a tool rod 48, the forward work piece 44 has a non-circular rod 60 and a turning tool 62 on at least one end thereof, preferably on both ends. In this alternative, the central axial passageways 30 42 in the forward end tip 24 and the barrier 40 are non-circular and have the same cross-sectional shape as the forward work piece 44.

A spring retainer 64 having a forward end 66 and a rearward end 68 protrudes radially outwardly from the outer surface 56 of the forward work piece 44. The forward work piece 44 fits in the forward portion of the device 1, passing through the central passageways 30 42 of the forward end tip 24 and the barrier 40. The cross-sectional size of the forward work piece 44 is such that it fits freely through these passageways without excessive play. The spring retainer 64 is so placed as to allow withdrawal of the forward work piece 44 from an extended position into the forward end tip 24 upon rearward movement of the forward work piece 44 before the forward work piece 44 is stopped by the abutment of the spring retainer 64 with the barrier 40.

A coil spring 70 having a forward end 72 and a rearward end 74 fits around the forward work piece 44 between the rearward base 26 of the forward end tip 24 and the spring retainer 64. The forward end 72 of the spring 70 rests against the rearward base 26 of the forward end tip 24 and the rearward end 74 of the spring 70 rests against the forward end 66 of the spring retainer 64. The purpose of the spring 70 is to urge the forward work piece 44 rearwardly.

A rearward endpiece 76 is attached to the rearward end 14 of the casing 4. Attachment may be in any convenient manner. The methods described for attaching the forward end tip 24 to the forward end 12 of the casing 4 are suitable. Inside the rearward endpiece 76 there is a smaller ring 78 which contains a non-circular central axial passageway 80. The ring 78 may be removably mounted in the rearward endpiece 76 by methods which will not allow turning of the rearward endpiece 76 or the ring 78 when torque is applied to the passageway 80. A preferred method is by the use of bolts. Alternatively, the rearward endpiece 76, including the portion surrounding the non-circular passageway 80, may be of a single piece. In this event, the rearward endpiece 76 should not be connected to the casing 4 by means of threads. The passageway 80 is non-circular so that a tool rod 82 will not slip upon the application of torque. The preferred shape is hexagonal, although any non-circular shape is suitable.

A tool rod 82 fits through the non-circular passageway 80. The tool rod 82 contains a forward end 84 and a rearward end 86 with a turning tool 62 on at least one end. The turning tool 62 may be a Phillips head screwdriver, a flat head screwdriver, a torx, an Allen wrench, or other turning tool. Two separate turning tools 62 or different sized tools 62 of the same type may be used on the same tool rod 82. The cross-sectional size and shape of the tool rod 82 is such that the tool rod 82 fits freely through the non-circular passageway 80 without excessive play.

A rearward extension/retraction pin 90 is located inside the casing 4 and is so sized as to slide along the inner surface 8 of the casing 4 and leaving a small space between the pin 90 and the inner surface 8 at the top aspect 6 of the casing 4. Subject to the features noted below, the pin 90 is of the same shape as the inner surface 8 of the casing 4. The pin 90 contains a flat forward end 92. The rearward end 94 of the pin 90 contains a central axial opening 96 having a forward end 98 to accept and abut with the forward end 84 of the tool rod 82. There is an extended space rearwardly of the forward end 98 of the central axial opening 96. The rearmost portion of this extended space contains a bushing 100, which creates a cylindrical extended space just forward of the bushing 100. This cylindrical extended space contains an O-ring 102 which applies a holding pressure against the tool rod 82.

This pressure is such that the tool rod 82 will not be removed with light force, such as gravity, but will be removed with moderate force, such as a manually applied separation force.

Forwardly of the central axial opening 96, the pin 90 contains an actuator opening 104 having a side wall 106, a closed bottom end 108, and an open top end 110. The actuator opening 104, holds a latch button a 112. The actuator opening 104 is laterally extended at the top 110 to form a seat 114 for the latch button 112. A coil actuator spring 116 having a top end 118 and a bottom end 120 fits into the actuator opening 104. The purpose of this spring 116 is to urge the latch button 112 upwardly. A latch button 112 having a side wall 122 having an inner 124 and outer 126 surface fits into the actuator opening 104 between the actuator spring 116 and the side wall 106 of the actuator opening 104. The latch button 112 contains a top piece 128 which contains a plurality of levels. An upper level 130 of the top piece 128 is of a size and shape to fit through the longitudinal extension/retraction slot 16. A medial level 132 of the top piece 128 is of a size and shape so as to fit within the latch openings 18 20 22 in the longitudinal extension/retraction slot 16. A lower level 134 of the top piece is of such a size and shape that it is larger than the latch openings 18 20 22. When the latch button 112 is in a latch opening 18 20 22 in the longitudinal slot 16, the latch button 112 is urged upwardly by the actuator spring 116, forcing the medial level 132 of the top piece 128 into a latch opening 18 20 22. In this position, the latch button 112 is locked in the latch opening 18 20 22 and the rearward extension/retraction pin 90 cannot be moved longitudinally in the longitudinal slot 16. When the latch button 112 is in the down position because of externally applied pressure, the medial level 132 becomes disengaged from the latch opening 18 20 22 in the longitudinal slot 16 and the rearward extension/retraction pin 90 may be moved longitudinally within the extension/retraction slot 16. This movement allows the pin 90 to be moved to the forward latch opening 18, the medial latch opening 20, or the rearward latch opening 22. When the rearward extension/retraction pin 90 is in the forward latch opening 18, the forward work piece 44 is extended and the tool rod 82 is retracted. When the rearward extension/retraction pin 90 is in the medial latch opening 20, both the forward work piece 44 and the tool rod 82 are retracted. When the rearward extension/retraction pin 90 is in the rearward latch opening 22, the forward work piece 44 is retracted and the tool rod 82 is extended. Thus, the device 1 allows for quick, simple change between a turning tool 62 or writing point 58 carried on the forward work piece 44 and a turning tool 62 on the rearwardly positioned tool rod 82. The device 1 gives the appearance that the user is carrying a writing implement and avoids the appearance that the user is carrying a screwdriver or other tool.

The second preferred embodiment will now be described.

The second preferred embodiment of the device 2 comprises a casing 4 which is the same as that of the first preferred embodiment except the casing 4 of the second preferred embodiment has forward 136 and rearward 138 longitudinal extension/retraction slots extending through it. The forward slot 136 has forward 140 and rearward 142 latch openings and the rearward slot 138 has forward 156 and rearward 158 latch openings, which are enlarged openings in the slots 136 138. Preferably these slots 136 138 are in a line, but any nonlinear relationship is satisfactory.

The forward end tip 24 of the second preferred embodiment is the same as that of the first preferred embodiment.

There is no barrier 40 in the second embodiment.

The forward work piece 44 of the second preferred embodiment, including the coil spring 70 and spring retainer 64, is the same as the forward work piece 44 of the first preferred embodiment, The rearward endpiece 76 of the second embodiment is the same as that of the first embodiment.

The tool rod 82 of the second embodiment is the same as that of the first embodiment.

The device 2 of the second embodiment contains a forward extension/retraction pin 144 and a rearward extension/retraction pin 90 which are associated with the forward 136 and rearward 138 extension/retraction longitudinal slots, respectively.

The forward extension/retraction pin 144 is located inside the casing 4 and is so sized and shaped as to slide along the inner surface 8 of the casing leaving a small space between the forward extension/retraction pin 144 and the inner surface 8 adjacent the top aspect 6 of the casing 4. Subject to the features noted below, the forward extension/retraction pin 144 is of the same shape as the inner surface 8 of the casing 4. The forward extension/retraction pin 144 contains a flat rearward end 146. The forward end 148 of the forward extension/retraction pin 144 contains a central anal opening 150 having a forward end 152 to accept the rearward end 52 of the forward work piece 44. No bushing or holding O-ring is present. Rearwardly of the central anal opening 150 in the forward extension/retraction pin 144, the pin 144 contains an actuator opening 104 for a latch button 112. This actuator opening 104 with the associated coil actuator spring 116 and latch button 112 are the same as the corresponding latching mechanism in the first preferred embodiment. The forward extension/retraction pin 144 may be moved to the forward latch opening 140 or the rearward latch opening 142 of the forward extension/retraction slot 136. When the forward extension/retraction pin 144 is in the forward latch opening 140, the forward work piece 44 is extended and when the forward extension/retraction pin 144 is in the rearward latch opening 142, the forward work piece 44 is retracted.

The rearward extension/retraction pin 90 of the second embodiment is the same as that of the first embodiment. When the rearward extension/retraction pin 90 of the rearward extension/retraction slot 138 is in the forward latch opening 156, the tool rod 82 is retracted. When the rearward extension/retraction pin 90 is in the rearward latch opening 158, the tool rod 82 is extended.

Thus, the device 2 of the second embodiment allows for independent control of the forward work piece 44 and the tool rod 82.

The third preferred embodiment will now be described.

In the third preferred embodiment, the device 3 has the same outward appearance as the device 2 of the second preferred embodiment. The device 3 comprises a casing 4 which is the same as that of the second preferred embodiment.

The forward end tip 24 of the third preferred embodiment is the same as that of the first and second preferred embodiments.

In the third preferred embodiment, there is no barrier 40, no spring retainer 64, and no coil spring 70. The third preferred embodiment contains forward 136 and rearward 138 extension/retraction slots the same as in the second embodiment. The forward extension/retraction pin 160 contains a forward central axial opening 162 to accept the rearward end 52 of the forward word piece 44. This opening contains a bushing 100 and an O-ring 102 which act to hold the rearward end 52 of the forward work piece 44. The forward extension/retraction pin 160 contains an actuator opening 104 which contains a latch button 112 in the same manner as the first and second preferred embodiments. The latch button 112 fits into a latch opening 140 142 of the forward extension/retraction slot 136 for extension and retraction of the forward work piece 44.

The rearward extension/retraction pin 90 contains a rearward central axial opening 96 containing a bushing 100 and an O-ring 102 forward of the central axial opening 96 to accept and abut with the forward end 84 of the tool rod 82 the same as in the first and second preferred embodiments.

When the forward extension/retraction pin 144, is in the forward latch opening 140, the forward work piece 44 is extended and when the forward extension/retraction pin 144 is in the rearward latch opening 142, the forward work piece 44 is retracted. When the rearward extension/retraction pin 90 of the rearward extension/retraction slot 138 is in the forward latch opening 156, the tool rod 82 is retracted. When the rearward extension/retraction pin 90 is in the rearward latch opening 158, the tool rod 82 is extended.

The fourth preferred embodiment of this invention will now be described.

In the fourth preferred embodiment, the device 5 comprises a casing 4 having a top aspect 6, an inner surface 8, an outer surface 10, a forward end 12, and a rearward end 14. The casing 4 has forward 164 and rearward 138 longitudinal extension/retraction slots extending through it. The forward slot 164, is a straight longitudinal axial opening in the casing 4 and contains a forward end 166 and a rearward end 168, but no latch openings. The rearward slot 138 is the same as that in the second and third preferred embodiments.

The forward tip 26 of the fourth preferred embodiment is the same as that of the first three preferred embodiments, the central passageway 30 being circular in cross-section.

There is no barrier in the fourth preferred embodiment. There is, however, a coil spring 70 and a spring retainer 64.

The forward work piece 44 of the fourth preferred embodiment is a chuck 170 for holding graphite or other writing medium 172. The chuck 170 has a forward end 174, a main body 176, a rearward end 178, an inner surface 180 forming a bore, and an outer surface 182. At the forward end 174 of the chuck 170, there is a gripping tip 184 which is larger in cross-sectional diameter than that of the main body 176 of the chuck 170 and is divided by longitudinal slits 186 into a plurality of sections 188. When the gripping tip 184 lies outside of the forward tip 24, the bore of the gripping tip 184 is larger than the bore of the main body 176 of the chuck 170. When the chuck 170 contains a writing medium 172, rearward urging by the coil spring 70 will push the chuck 170 rearwardly until abutment of the gripping tip 184 with the inner surface 180 of the central passageway 30 at the forward apex 28 of the forward tip 24 allows no further rearward movement of the gripping tip 184. At that point, the gripping tip 184 will hold the writing medium 172 in place. The chuck a 170 contains a spring retainer 64 having a forward end 66 and a rearward end 68 protruding radially outwardly from the outer surface 182, of the chuck 170. The chuck 170 is circular in cross-section and fits in the forward portion of the device 5, passing through the circular central passageway 30 of the forward tip 24. The spring retainer 64 is so placed as to allow fill withdrawal of the chuck 170 into the forward tip 24 upon the fill extent of the rearward movement of the chuck 170 providing no wring medium 172 is in the chuck 170.

The coil spring 70 of the fourth preferred embodiment is the same as in the first two preferred embodiments.

The rearward endpiece 76 of the fourth preferred embodiment is the same as that of the first three preferred embodiments.

The tool rod 82 of the fourth preferred embodiment is the same as that of the first three preferred embodiments.

The device 5 of the fourth preferred embodiment contains a forward extension/retraction pin 190 and a rearward extension/retraction pin 90 which are associated with the forward 164, and rearward 138 extension/retraction longitudinal slots, respectively.

The forward extension/retraction pin 190 is located inside the casing 4 and is so sized as to slide along the inner surface 8 of the casing. Subject to the features noted below, the pin 190 is of generally cylindrical shape. The pin 190 contains a flat rearward end 192. The forward end 194 of the pin 190 contains a central circular axial opening 196 having a forward end 198 to accept the rearward end 178 of the chuck 170. No bushing or holding O-ring is present in the forward extension/retraction pin 190 of the fourth preferred embodiment. Rearwardly of the central axial opening 196 in the forward extension/retraction pin 190, the pin 190 contains a radial outwardly extending elongated protrusion 200 for manual control of the chuck 170. This protrusion 200 fits through the forward extension/retraction slot 164 in the casing 4. The forward extension/retraction pin 190 is normally held at the rearward end 168 of the forward extension/retraction slot 164 by pressure of the coil spring 70. The forward extension/retraction pin 190 may be moved to a forward position in the forward extension/retraction slot 164 by external manual pressure. When the pin 190 is in the forward position, the gripping tip 184 of the chuck 170 is extended and when the pin 190 is in the rearward position, the chuck 170 is retracted. When the chuck 170 is extended, the gripping tip 184 expands laterally and new writing medium 172 may be inserted or the position of writing medium 172 in the chuck 170 may be changed. Release of the protrusion 200 will cause the pin 190 to move rearwardly due to the force of the coil spring 70 and hold the loaded chuck 170 at the forward apex 28 of the forward tip 24.

The rearward extension/retraction pin 90 of the fourth preferred embodiment is the same as that of the first three preferred embodiments. When the rearward extension/retraction pin 90 of the rearward extension/retraction slot 138 is in the forward latch opening 156, the tool rod 82 is retracted. When the rearward extension/retraction pin 90 is in the rearward latch opening 158, the tool rod 82 is extended.

Thus, the fourth embodiment provides for a convenient combination of a pencil and a turning tool 62 wherein the turning tool 62 may be easily extended or retracted and wherein loading, extending, and retraction of the writing medium 172 in the pencil is simply accomplished.

The device 1 2 3 5 of the present invention may be used as described above or it may be in combination with a pocket clip 202. Any conventional pocket clip 202 may be employed. However, the following clip is preferred.

The pocket clip 202 comprises a collar 206 containing an upper end 206 and a lower end 208 for fitting around the casing 4 of the device 1 2 3 5. Preferably, the collar 204 is a snap-on collar 204 to enable the clip 202 to fit around devices 1 2 3 5 having a range of sizes. Two parallel holding walls 210 extend outwardly from the collar 204. A pivot rod 212 extends between the two holding walls 210. A clip body 214 has an upper segment 216 capable of receiving external manual pressure. The clip body 214 has a middle segment 218 which has walls 220 which fit between the two holding walls 210 and which fit over, and pivot around, the pivot rod 212. The clip body 214 has a lower segment 222 which contains an extended, textured gripping head 224. A tension spring 226 having two ends 228 230 is coiled around the pivot rod 212. One end 228 of the spring 226 abuts the upper end 206 of the collar 204, and the other end 230 abuts the upper segment 216 of the clip body 214. When the upper segment 216 of the clip body 214 is manually pushed toward the collar 204 the lower segment 222 containing the gripping head 224 is pivoted away from the casing 4 allowing simple insertion into, and retraction from, a pocket of the device 1 2 3 5. When the upper segment 216 is released, the tension spring 226 forces the gripping head 224 toward the device 1 2 3 5 and ensures a tight grip on the pocket. Thus, use of this clip 202 results in a tight fit of the device 1 2 3 5 on a pocket, resulting in a lowered chance of losing the device 1 2 3 5 when the user bends over.

Obviously, numerous modifications and variations of the present invention are possible in light of the above teachings. It is therefore to be understood that within the scope of the appended claims, the invention may be practiced otherwise than as specifically described herein.

I claim:

1. A device comprising:

a hollow casing of such dimensions as to be held in the hand, said casing having inner and outer surfaces, a forward end, a rearward end, and a longitudinal extension/retraction slot through the casing, which slot has forward, medial, and rearward latch openings;

a forward tip having a rearward base and a forward apex, the tip being affixed to the forward end of the casing, which tip contains a central axial passageway;

a barrier fixedly located inside the casing approximately one quarter of the distance from the forward end to the rearward end, which barrier contains a central axial passageway; button must remain in a forward, medial, or rearward latch opening in the extension/retraction slot.

2. The device of claim 1, wherein the turning tool is at least one of a Phillips head screwdriver, a flat head screwdriver, a torx, or an Allen wrench.

3. The device of claim 1, wherein the non-circular central axial passageway in the rearward endpiece is hexagonal in shape.

4. The device of claim 1, wherein the forward work piece is an ink cartridge.

5. The device of claim 1 in combination with a pocket clip, wherein the pocket clip comprises a collar fitting around the casing of the device, two parallel holding walls extending outwardly from the collar, a pivot rod extending between the two holding walls, a clip body having an upper segment capable of receiving external manual pressure, a middle segment which has walls which fit over, and pivot around, the pivot rod, and a lower segment which contains a textured gripping head, and a spring having two ends, which spring is coiled around the pivot rod, the first end of the spring abuts the collar and the second end of the spring abuts the upper segment of the clip body.

6. A device comprising:

a hollow casing of such dimensions as to be held in the hand, said casing having inner and outer surfaces, a forward end, a rearward end, a forward longitudinal extension/retraction slot through the casing, which slot has forward and rearward latch openings and a rearward longitudinal extension/retraction slot through the casing, which slot has forward and rearward latch openings;

a forward tip having a rearward base and a forward apex, the tip being affixed to the forward end of the casing, which tip contains a central axial passageway;

a forward work piece which is a member selected from the group consisting of 1) an ink cartridge having a forward end, a rearward end, an outer surface, and a writing point at the forward end and 2) a tool rod having a forward end, a rearward end, an outer surface and a turning tool on at least one end, wherein the forward work piece has a spring retainer protruding radially outwardly from the outer surface of the forward work a forward work piece which is a member selected from the group consisting of 1) an ink cartridge having a forward end, a rearward end, an outer surface, and a writing point at the forward end and 2) a tool rod having a forward end, a rearward end, an outer surface and a turning tool on at least one end, wherein the forward work piece has a spring retainer protruding radially outwardly from the outer surface of the forward work piece, the forward work piece being of such size as to fit freely through the central axial passageways in the tip and the barrier without excessive play;

a coil spring around the forward work piece, which coil spring has a forward end and a rearward end, the forward end of the spring resting against the rearward base of the tip and the rearward end of the spring resting against the spring retainer, which spring urges the forward work piece rearwardly;

a rearward endpiece affixed to the rearward end of the casing, which rearward endpiece contains a non-circular central axial passageway;

a rearward tool rod containing a forward end, a rearward end, and a turning tool on at least one end, the tool rod being of such a size as to fit freely through the central axial passageway of the rearward endpiece without excessive play;

an extension/retraction pin located inside the casing and so sized as to slide along the inner surface of the casing, which pin contains a flat forward end and a rearward end, the rearward end being open and adapted to receive and hold the forward end of the rearward tool rod, the extension/retraction pin having a latch button spring-mounted therein in such a manner that when the latch button is depressed, the extension/retraction pin may be moved longitudinally along the extension/retraction slot in the casing to extend or retract the forward work piece through the central passageway in the forward tip and to extend or retract the rearward tool rod through the central axial passageway in the rearward endpiece and in such a manner that when the latch button is raised, the latch piece, the forward work piece being of such size as to fit freely through the central axial passageways in the forward tip and the barrier without excessive play;

a coil spring around the forward work piece, which coil spring has a forward end and a rearward end, the forward end of the spring resting against the rearward base of the tip and the rearward end of the spring resting against the spring retainer, which spring urges the forward work piece rearwardly;

a rearward endpiece affixed to the rearward end of the casing, which rearward endpiece contains a non-circular central axial passageway;

a rearward tool rod containing a forward end, a rearward end, and a turning tool on at least one end, the tool rod being of such a size as to fit freely through the central axial passageway of the rearward endpiece without excessive play;

a forward extension/retraction pin located inside the casing and so sized as to slide along the inner surface of the casing, which pin contains an open forward end adapted to receive the rearward end of the forward work piece and a flat rearward end, a rearward extension/retraction pin located inside the casing and so sized as to slide along the inner surface of the casing, which pin contains a flat forward end and a rearward end, the rearward end being open and adapted to receive and hold the forward end of the rearward tool rod;

each of the extension/retraction pins having a latch button spring-mounted therein in such a manner that when the latch button is depressed, the extension/retraction pin may be moved longitudinally along the corresponding extension/retraction slot in the casing to extend or retract the forward work piece through the central axial passageway in the forward tip or to extend or retract the rearward tool rod through the central axial passageway in the rearward endpiece and in such a manner that when the latch button is raised, the latch button must remain in a forward or rearward latch opening in the corresponding extension/retraction slot.

7. The device of claim 6, wherein the turning tool is at least one of a Phillips head screwdriver, a flat head screwdriver, a torx, or an Allen wrench.

8. The device of claim 6 wherein the non-circular central axial passageway in the rearward endpiece is hexagonal in shape.

9. The device of claim 6, wherein the forward workpiece is an ink cartridge.

10. The device of claim 6 comprising a pocket clip, wherein the pocket clip comprises a collar fitting around the casing of the device, two parallel holding walls extending outwardly from the collar, a pivot rod extending between the two holding walls, and a clip body having an upper segment capable of receiving external manual pressure, a middle segment which has walls which fit over, and pivot around, the pivot rod, and a lower segment which contains a textured gripping head and a spring having two ends, which spring is coiled around the pivot rod, the first end of the spring abuts the collar and the second end of the spring abuts the upper segment of the clip body.

11. A device comprising:

a hollow casing of such dimensions as to be held in the hand, said casing having inner and outer surfaces, a forward end, a rearward end, a forward longitudinal extension/retraction slot through the casing, which slot has forward and rearward latch openings and a rearward longitudinal extension/retraction slot through the casing, which slot has forward and rearward latch openings;

a forward tip having a rearward base and a forward apex, the tip being affixed to the forward end of the casing, which tip contains a central axial passageway;

a forward work piece which is a member selected from the group consisting of 1) an ink cartridge having a forward end, a rearward end, an outer surface, and a writing point at the forward end and 2) a tool rod having a forward end, a rearward end, an outer surface and a turning tool on at least one end, the forward work piece being of such size as to fit freely through the central axial passageways in the forward tip without excessive play;

a rearward endpiece affixed to the rearward end of the casing, which rearward endpiece contains a non-circular central axial passageway;

a rearward tool rod containing a forward end, a rearward end, and a turning tool on at least one end, the tool rod being of such a size as to fit freely through the central axial passageway of the rearward endpiece without excessive play;

a forward extension/retraction pin located inside the casing and so sized as to slide along the inner surface of the casing, which pin contains an open forward end adapted to receive and hold the rearward end of the forward work piece and a flat rearward end;

a rearward extension/retraction pin located inside the casing and so sized as to slide along the inner surface of the casing, which pin contains a flat forward end and a rearward end, the rearward end being open and adapted to receive and hold the forward end of the rearward tool rod;

each of the extension/retraction pins having a latch button spring-mounted therein in such a manner that when the latch button is depressed, the extension/retraction pin may be moved longitudinally along the corresponding extension/retraction slot in the casing to extend or retract the forward work piece through the central axial passageway in the forward tip or to extend or retract the rearward tool rod through the central axial passageway in the rearward endpiece and in such a manner that when the latch button is raised, the latch button must remain in a forward or rearward latch opening in the corresponding extension/retraction slot.

12. The device of claim 11, wherein the turning tool is at least one of a Phillips head screwdriver, a flat head screwdriver, a torx, or an Allen wrench.

13. The device of claim 11 wherein the non-circular central axial passageway in the rearward endpiece is hexagonal in shape.

14. The device of claim 11, wherein the forward workpiece is an ink cartridge.

15. The device of claim 11 with a pocket clip, wherein the pocket clip comprises a collar fitting around the casing of the device, two parallel holding walls extending outwardly from the collar, a pivot rod extending between the two holding walls, a clip body having an upper segment capable of receiving external manual pressure, a middle segment which has walls which fit over, and pivot around, the pivot rod, and a lower segment which contains a textured gripping head, and a spring having two ends, which spring is coiled around the pivot rod, the first end of the spring abuts the collar and the second end of the spring abuts the upper segment of the clip body.

16. A device which is a combination pencil and turning tool, comprising:

a hollow casing of such dimensions as to be held in the hand, said casing having inner and outer surfaces, a forward end, a rearward end, a forward longitudinal extension/retraction slot through the casing, which slot has forward and rearward ends and a rearward longitudinal extension/retraction slot through the casing, which slot has forward and rearward latch openings;

a forward tip having a rearward base and a forward apex, the tip being affixed to the forward end of the casing, which tip contains a central axial passageway;

a chuck for holding a writing medium rod, the chuck having an outer surface, a forward end, a rearward end, a gripping tip at the forward end, and a spring retainer protruding radially outwardly from the outer surface of the chuck, the chuck being of such size as to fit freely through the central axial passageway in the forward tip without excessive play;

a coil spring around the chuck, which coil spring has a forward end and a rearward end, which spring is located between the rearward base of the tip and the spring retainer, the forward end of the spring resting against the rearward base of the tip and the rearward end of the spring resting against the spring retainer, which spring urges the chuck rearwardly;

a rearward endpiece affixed to the rearward end of the casing, which endpiece contains a non-circular central axial passageway;

a rearward tool rod, which tool rod contains a forward end and a rearward end and has a turning tool on at least one end, the tool rod being of such a size as to fit freely through the central axial passageway of the rearward endpiece without excessive play;

a forward extension/retraction pin located inside the casing and so sized as to slide along the inner surface of the casing, which pin contains an open forward end adapted to receive and hold the rearward end of the chuck and a flat rearward end, the forward extension/retraction pin containing a protrusion which extends through the forward extension/retraction slot so that when the protrusion is manually pushed forward, the forward extension/retraction pin moves forwardly and when the protrusion is released, the forward extension/retraction pin moves to the rearward end of the forward extension/retraction slot due to urging by the coil spring;

a rearward extension/retraction pin located inside the casing and so sized as to slide along the inner surface of the casing, which pin contains a flat forward end and a rearward end, the rearward end being open and adapted to receive and hold the forward end of the rearward tool rod, the rearward extension/retraction pin having a latch button mounted therein in such a manner that when the latch button is depressed, the rearward extension/retraction pin may be moved longitudinally along the rearward extension/retraction slot in the casing to extend or retract the rearward tool rod through the central axial passageway in the rearward endpiece and in such a manner that when the latch button is raised, the latch button must remain in the forward or rearward latch opening in the rearward extension/retraction slot.

17. The device of claim 16, wherein the turning tool is at least one of a Phillips head screwdriver, a flat head screwdriver, a torx, or an Allen wrench.

18. The device of claim 16, wherein the non-circular central axial passageway in the rearward endpiece is hexagonal in shape.

19. The device of claim 16, wherein the device has a circular cross-section.

20. The device of claim 16 with a pocket clip, wherein the pocket clip comprises a collar fitting around the casing of the device, two parallel holding walls extending outwardly from the collar, a pivot rod extending between the two holding walls, and a clip body having an upper segment capable of receiving external manual pressure, a middle segment which has walls which fit over, and pivot around, the pivot rod, and a lower segment which contains a textured gripping head and a spring having two ends, which spring is coiled around the pivot rod, the first end of the spring abuts the collar and the second end of the spring abuts the upper segment of the clip body.

* * * * *

UNITED STATES PATENT AND TRADEMARK OFFICE

CERTIFICATE OF CORRECTION

PATENT NO. : 5,916,278

DATED : June 29, 1999

INVENTOR(S) : Frank Garcia

It is certified that error appears in the above-indentified patent and that said Letters Patent is hereby corrected as shown below:

In Col 6, Lines 23 and 26, "anal" should read --axial--.

In Col. 7, lines 62 and 63, "fill" should read --full--; line 64, "wring" should read --writing--.

Claim 1 should be rewritten as follows:

1. A device comprising:

a hollow casing of such dimensions as to be held in the hand, said casing having inner and outer surfaces, a forward end, a rearward end, and a longitudinal extension/retraction slot through the casing, which slot has forward, medial, and rearward latch openings;

a forward tip having a rearward base and a forward apex, the tip being affixed to the forward end of the casing, which tip contains a central axial passageway;

a barrier fixedly located inside the casing approximately one quarter of the distance from the forward end to the rearward end, which barrier contains a central axial passageway;

a forward work piece which is a member selected from the group consisting of 1) an ink cartridge having a forward end, a rearward end, an outer surface, and a writing point at the forward end and 2) a tool rod having a forward end, a rearward end, an outer surface and a turning tool on at least one end, wherein the forward work piece has a spring retainer protruding radially outwardly from the outer surface of the forward work piece, the forward work piece being of such size as to fit freely through the central axial passageways in the tip and the barrier without excessive play;

a coil spring around the forward work piece, which coil spring has a forward end and a rearward end, the forward end of the spring resting against the rearward base of the tip and the It is certified that error appears in the above-indentified patent and that said Letters Patent is hereby corrected as shown below:

rearward end of the spring resting against the spring retainer, which spring urges the forward work piece rearwardly;

a rearward endpiece affixed to the rearward end of the casing, which rearward endpiece contains a non-circular central axial passageway;

a rearward tool rod containing a forward end, a rearward end, and a turning tool on at least one end, the tool rod being of such a size as to fit freely through the central axial passageway of the rearward endpiece without excessive play;

an extension/retraction pin located inside the casing and so sized as to slide along the inner surface of the casing, which pin contains a flat forward end and a rearward end, the rearward end being open and adapted to receive and hold the forward end of the rearward tool rod, the extension/retraction pin having a latch button spring-mounted therein in such a manner that when the latch button is depressed, the extension/retraction pin may be moved longitudinally along the extension/retraction slot in the casing to extend or retract the forward work piece through the central passageway in the forward tip and to extend or retract the rearward tool rod through the central axial passageway in the rearward endpiece and in such a manner that when the latch button is raised, the latch button must remain in a forward, medial, or rearward latch opening in the extension/retraction slot.

UNITED STATES PATENT AND TRADEMARK OFFICE

CERTIFICATE OF CORRECTION

PATENT NO. : 5,916,278

DATED : June 29, 1999

INVENTOR(S) : Frank Garcia

It is certified that error appears in the above-indentified patent and that said Letters Patent is hereby corrected as shown below:

a hollow casing of such dimensions as to be held in the hand, said casing having inner and outer surfaces, a forward end, a rearward end, a forward longitudinal extension/retraction slot through the casing, which slot has forward and rearward latch openings and a rearward longitudinal extension/retraction slot through the casing, which slot has forward and rearward latch openings;

a forward tip having a rearward base and a forward apex, the tip being affixed to the forward end of the casing, which tip contains a central axial passageway;

a forward work piece which is a member selected from the froum consisting of1) an ink cartridge having a forward end, a rearward end, an outer surface, and a writing point at the forward end and 2) a tool rod having a forward end, a rearward end, an outer surface and a turning tool on at least one end, wherein the forward work piece has a spring retainer protruding radially outwardly from the outer surface of the forward work piece, the forward work piece being of such size as to fit freely through the central axial passageways in the forward tip and the barrier without excessive play;

a coil spring around the forward work piece, which coil spring has a forward end and a rearward end, the forward end of the spring resting against the rearward base of the tip and the rearward end of the spring resting against the spring retainer, which spring urges the forward work piece rearwardly;

UNITED STATES PATENT AND TRADEMARK OFFICE

CERTIFICATE OF CORRECTION

PATENT NO. : 5,916,278

DATED : June 29, 1999

INVENTOR(S) : Frank Garcia

It is certified that error appears in the above-indentified patent and that said Letters Patent is hereby corrected as shown below:

a rearward endpiece affixed to the rearward end of the casing, which rearward endpiece contains a non-circular central axial passageway;

Signed and Sealed this

Twenty-third Day of November, 1999

*Attest:*

*Attesting Officer*

Q. TODD DICKINSON

*Acting Commissioner of Patents and Trademarks*